US011980275B2

(12) United States Patent
Naso et al.

(10) Patent No.: US 11,980,275 B2
(45) Date of Patent: May 14, 2024

(54) FRAGRANCE SAMPLING DEVICE

(71) Applicant: IDSCENT, Bron (FR)

(72) Inventors: Julie Naso, Meyzieu (FR); Maxime Caffon, Cremieu (FR); Michel Caffon, Meyzieu (FR)

(73) Assignee: IDSCENT, Bron (FR)

( * ) Notice: Subject to any disclaimer, the term of this patent is extended or adjusted under 35 U.S.C. 154(b) by 458 days.

(21) Appl. No.: 16/856,179

(22) Filed: Apr. 23, 2020

(65) Prior Publication Data

US 2020/0337438 A1 Oct. 29, 2020

(30) Foreign Application Priority Data

Apr. 24, 2019 (FR) ..... 1904321

(51) Int. Cl.
*A45D 40/00* (2006.01)

(52) U.S. Cl.
CPC ..... *A45D 40/0087* (2013.01); *A45D 2200/05* (2013.01); *A45D 2200/10* (2013.01)

(58) Field of Classification Search
CPC ..... A45D 40/0087; A45D 2200/05; A45D 2200/10
See application file for complete search history.

(56) References Cited

U.S. PATENT DOCUMENTS 4,847,124 A 7/1989 Lux Nee Andrieux
4,889,755 A * 12/1989 Charbonneau ..... D06M 23/12 428/905
4,988,557 A 1/1991 Charbonneau
4,998,621 A 3/1991 Meehan
5,050,910 A * 9/1991 Schechter ..... B42D 1/007 283/105
5,242,521 A 9/1993 Hibsch et al.
5,445,821 A * 8/1995 Brown ..... A61Q 13/00 428/905
2008/0011319 A1* 1/2008 Ripoli ..... A45D 40/0087 132/286
2010/0016347 A1 1/2010 Nandy et al.
2010/0048449 A1 2/2010 De Pous
(Continued)

FOREIGN PATENT DOCUMENTS

CA 2105194 3/1994
EP 0297959 1/1989
(Continued)

OTHER PUBLICATIONS

Rapport de Recherche Preliminaire et Opinion Ecrite [Preliminary Search Report and Written Opinion] dated Feb. 6, 2020 From the Institut National de la Propriete Industrielle de la Republique Francaise, INPI Re. Application No. FR 1904321. (8 Pages).

*Primary Examiner* — J C Jacyna

(57) ABSTRACT

Fragrance sampling device comprising a reservoir in the form of a pouch, having two outside walls facing one another, intended to receive an applicator in the form of a tongue, characterized in that at least one of the faces of the tongue and/or the inside face of at least one of the walls of the pouch contains a fragrant substance and in that the applicator further comprises a grasping means connected to the tongue and fully emerging from the reservoir, the applicator being devoid of means for the temporary connection thereof to the outside walls of the pouch.

17 Claims, 2 Drawing Sheets

(56) References Cited

U.S. PATENT DOCUMENTS

| | | | | |
|---|---|---|---|---|
| 2011/0194983 | A1 | 8/2011 | Gough et al. | |
| 2013/0015258 | A1 | 1/2013 | Boyles | |
| 2016/0113377 | A1* | 4/2016 | Moussion | B65D 75/322 401/132 |

FOREIGN PATENT DOCUMENTS

| | | |
|---|---|---|
| EP | 0378411 | 7/1990 |
| EP | 1243199 | 9/2002 |
| FR | 2824291 | 11/2002 |
| GB | 2384228 | 7/2003 |

* cited by examiner

FRAGRANCE SAMPLING DEVICE

RELATED APPLICATION

This application claims the benefit of priority of French Patent Application No. 19 04321 filed on Apr. 24, 2019, the contents of which are incorporated herein by reference in their entirety.

FIELD AND BACKGROUND OF THE INVENTION

The invention relates to the field of fragrances. It more particularly concerns a device for sampling volatile fragrant substances in addition to the manufacturing method thereof. It further relates to the implementation of the device in magazines and newspapers. Finally, it relates to a fragrance inhalation method or fragrance application method implementing the aforementioned device.

The sampling of fragrances by perfumers generally takes place by two main avenues, namely either in perfume stores, or via newspapers or magazines.

In perfume stores, the samples are taken by means of perfume bottles which are made available to customers free of charge. In practice, the customer sprays a dose of fragrance either on the skin or on a paper support, which the customer then smells as he/she sees fit. Although this solution is the most common in perfume stores, it can potentially create environmental pollution problems arising from the presence of alcohol in the perfume bottles. More specifically, the more customers there are, the more fragrance that is sprayed and the higher the alcohol content of the atmosphere.

Sampling fragrances by way of the press is less problematic in this respect. More specifically, the samples are mostly present in the form of supports imbibed with fragrance, which supports may or may not be detached from the magazine. A plurality of technical solutions has been proposed, some of which are described hereinbelow in a non-exhaustive manner.

U.S. Pat. No. 4,847,124 has been cited in category X, i.e. as capable of affecting the novelty and/or inventive step of the original claim 1. This document discloses a fragrance sampling device comprising a reservoir in which a tongue is positioned. The tongue emerges from the reservoir by a grasping means representing the stopper of the bottle. The fragrance is applied to the tongue and is revealed by an abrasive film positioned on the inside walls of the bottle. The assembly is pressed at the same time as the tongue is removed to allow the fragrance to be diffused.

U.S. patent No. 2011/0194983 A1 discloses a composite capable of releasing fragrance by compression. This composite is formed by a perforated polymer surface layer, a foam imbibed with fragrance and a double-sided adhesive film. In practice, the device remains bonded inside the magazine and the user must renew the pressure exerted on the foam to be able to inhale the fragrance again. This device has the drawback of remaining attached to the magazine. Moreover, the foam is imbibed with liquid fragrance such that, once the film has been removed, the pages of the magazine may become damp.

Another solution is, for example, that disclosed in U.S. patent No. 2010/016347 A1. This document discloses a paper support in the form of a patch, provided with two faces folded over one another, the two faces being separated by a layer containing fragrant capsules. The separation of the two layers allows the fragrance to be revealed. This patch can be applied to a paper support in the shape of the bottle which is itself made integral with the page of the magazine. Although this device is detachable, it nonetheless suffers from certain drawbacks. In particular, it cannot be re-used in the sense that once the two faces have been separated, the fragrance evaporates without the possibility of effectively re-closing the device.

In order to overcome this drawback, U.S. Pat. No. 4,889,755 A discloses a jacket designed to receive a retractable rectangular tongue. The tongue is fastened to the inside walls of the jacket by means of an adhesive containing fragrance microcapsules. The microcapsules are dispersed within the adhesive such that, when removing the tongue, the microcapsules are ruptured under the shearing effect of the adhesive. This solution, although of interest, has the drawback of requiring the presence of an adhesive of a synthetic nature which, when removing the tongue, modifies the aromas of the fragrances. Moreover, the possibilities of reusing the device are limited in that all of the available microcapsules are ruptured during first use. Although the inside of the jacket retains a certain odor, reusing the system does not guarantee the original aromas. Finally, the method for manufacturing these samples is difficult to industrialize.

Furthermore, although all of the solutions as described in these different documents allow the fragrance to be inhaled in an isolated manner, they cannot be used as a fragrance applied directly to the skin.

The invention proposes overcoming the problem of developing a device that does not suffer from the aforementioned drawbacks.

In particular, the invention proposes overcoming one problem of proposing a device of the type described in U.S. Pat. No. 4,889,755 A, which can deliver the entirety of the aromas contained in the fragrance, in a repetitive manner, and which can be manufactured on an industrial scale.

The invention further proposes to overcome the problem of proposing a device that can be used both to inhale fragrance as well as to apply fragrance to the skin.

SUMMARY OF THE INVENTION

In order to overcome all of these problems, the invention proposes a fragrance sampling device, comprising a reservoir in the form of a pouch, having two outside walls facing one another. This pouch is intended to receive an applicator in the form of a tongue.

The sampling device is noteworthy in that at least one of the faces of the tongue and/or the inside face of at least one of the outside walls of the pouch contains a fragrant substance and in that the applicator further comprises a grasping means connected to the tongue and fully emerging from the reservoir the applicator being devoid of means for the temporary connection thereof to the outside walls of the pouch.

According to the invention, the pouch can take the shape of a bottle, a pot, a bag, preferentially the shape of a bottle, in particular a bottle in the shape of a perfume bottle.

In one specific embodiment, the pouch has an intermediate wall sandwiched between the two outside walls, the intermediate wall having a precut tongue-shape.

In practice, the precut shape made in the intermediate wall of the sampling device allows the applicator to be held in place inside the pouch before first use. In practice, the tongue of the applicator is fastened to the intermediate wall by means of at least three adhesion points.

The user will thus be able to easily remove the applicator from the pouch by breaking these adhesion points when removing the tongue after having grasped the grasping means. In other words, the tongue is removable and free to move in translation relative to the reservoir once the points connecting the tongue to the intermediate wall are broken. The insertion and guiding of the applicator in the reservoir within the volume occupied by the tongue are thus facilitated.

Advantageously, the walls of the pouch are integral with one another outside of the surface occupied by the tongue. An adhesive will preferably be used to rigidly connect these walls to one another. Advantageously, the part of the walls rigidly connected to one another is not covered in fragrant substance.

The applicator comprises a tongue in addition to a grasping means. The latter corresponds to the part emerging from the reservoir and advantageously takes the shape of a cap, in particular when the reservoir is present in the shape of a bottle.

The grasping means can correspond to a part fixed to the end of the tongue or can constitute a continuation of the tongue. It is preferably made of the same material as the tongue. It is preferably devoid of fragrant substance.

According to one preferred embodiment, the tongue is trapezoidal in shape and has a long base and a short base, the long base (corresponding to the maximum width thereof) being located at the opening of the pouch (upper base) and the short base being located in the vicinity of the bottom of the pouch (lower base). This specific shape facilitates the insertion of the tongue into the pouch.

The sampling device is made of a material that is adapted to being in contact with the skin and capable of containing a fragrant substance. It is advantageously made entirely or partially of paper, cardboard or silicone.

In one specific embodiment, the fragrant substance takes the form of a mixture of microcapsules.

The microcapsules forming this mixture preferably have variable-strength membranes: "weak" or "strong" membranes thus allowing the volatile substances to be released in a controlled manner over time.

According to the invention, the microcapsules having "weak" membranes denote those which release the fragrance during first use, whereas the microcapsules having the "stronger" membranes denote those which release the fragrance after being handled several times.

In practice, the microcapsules are impregnated in at least one, potentially in both faces of the tongue. This is carried out thanks to selective application of fragrance to the surface delimited by the precut shape of the tongue.

In certain embodiments, the microcapsules are also applied to the inside face of one of the outside walls of the pouch, advantageously the part of the inside face of the two outside walls of the pouch that is facing the tongue. This provides the possibility of recharging the tongue impregnated with fragrant substance by placing it in contact with the inside faces of the outside walls of the pouch, and thus of ensuring that the tongue is impregnated with this same substance over time, independently of the number of applications.

In another embodiment, the fragrant substance contained in the sampling device disclosed by the invention can take the form of any product adapted to topical application, for example a cream, a gel or a lotion.

In one preferred embodiment, the fragrant substance is applied to only one or to both of the faces of the tongue.

The invention further relates to any type of paper support, such as, for example, an advertisement page of a newspaper or magazine having the sampling device disclosed by the present invention bonded to the surface thereof.

It further relates to a method for inhaling fragrance implementing the device disclosed by the invention. This method is characterized in that it consists of releasing the fragrance contained in the fragrant substance, for example the microcapsules, by friction between the applicator and the walls of the pouch when removing said applicator, then of inhaling the fragrance thus released. In a subsequent step, the applicator can be recharged with fragrance by reinserting the applicator and by removing it again from the pouch.

Finally, it relates to a method for applying fragrance to the skin implementing the device disclosed by the invention. The method is characterized in that it consists of releasing the fragrant substance by friction between the applicator and the outside walls of the pouch when removing said applicator, then of brushing the skin with the applicator. In a subsequent step, the applicator can be recharged with fragrance by reinserting the applicator and by removing it again from the pouch.

The device of the invention can thus replace the sampling of fragrances in alcohol, thus preventing the risks stemming from the alcohol.

The invention further relates to a method for manufacturing a sampling device as described hereinabove.

In one specific embodiment, the invention relates to a method for manufacturing a fragrance sampling device comprising a reservoir in the form of a pouch intended to receive an applicator in the form of a tongue, at least one of the faces whereof contains a fragrant substance, and a grasping means, the pouch having two outside walls and an intermediate wall sandwiched between the two outside walls, the intermediate wall having a precut tongue shape, comprising:

in a first support:

identifying a first area corresponding to the first outside wall and a second area in the continuation of the first area and having a larger surface area than that of the grasping means, recessing the second area, in a second support, identifying a first area corresponding to the intermediate wall of the pouch, identifying a second area corresponding to the shape of an applicator comprising a tongue continued by a grasping means, precutting at least the part corresponding to the tongue, selectively applying fragrance to at least one face of the tongue, in a third support, identifying a first area corresponding to the second outside wall and a second area in the continuation of the first area and having a larger surface area than that of the grasping means, recessing the second area, selectively laminating, in an identified manner, the first and third supports on the second support such that the grasping means is positioned facing the recessed areas, cutting the assembly at the periphery of the first area and of the grasping means.

According to the invention, selective lamination is understood to mean bonding all of the surfaces of the outside and intermediate walls, with the exception of the area corresponding to the tongue.

In one specific embodiment, fragrance is selectively applied to the two faces of the tongue.

In another embodiment, a third area is identified, intended to be facing the tongue in at least the first or the third support, to which fragrance is selectively applied.

BRIEF DESCRIPTION OF THE SEVERAL VIEWS OF THE DRAWINGS

The mode for carrying out the invention, in addition to the advantages resulting therefrom, will be understood from the following description of embodiments, given with reference to the accompanying figures wherein.

DESCRIPTION OF SPECIFIC EMBODIMENTS OF THE INVENTION

Figure 1:
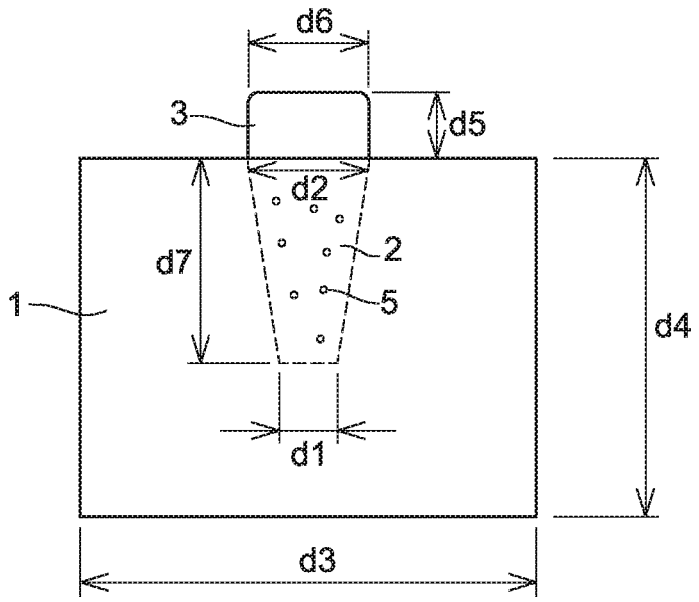
FIG. 1 is a diagrammatic view of the sampling device of the invention according to one specific embodiment.

With reference to FIG. 1, the sampling device according to the invention, in one specific embodiment, comprises a reservoir, in the form of a pouch 1 made of paper. The pouch is characterized by an overall polygonal shape, preferentially rectangular, having a length d4 of 7 cm for example, with a width d3 of 4 cm for example. It thus has the shape of a standard perfume bottle. It has a central opening d2, the length whereof is, for example, equal to 1.5 cm, into which an applicator is inserted. For the purposes of the figure, the tongue of the applicator is shown in the form of dotted lines.

Figure 2:
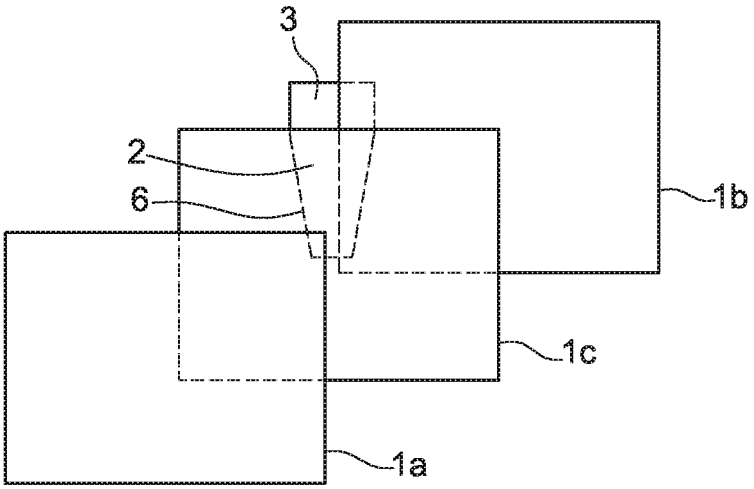
FIG. 2 is an exploded, perspective view of the device in FIG. 1.

As shown in FIGS. 1 and 2, the applicator is composed of a tongue 2 continued by a cap 3, the height d5 whereof measures about 1 cm and the width d6 whereof measures about 2.5 cm. The tongue 2 has an overall trapezoidal shape, the long base whereof being situated perpendicular to the opening d2 of the pouch 1 and the short base whereof, of length d1, being situated in the vicinity of the lower base of the pouch 1. In the embodiment as shown, the long base of the tongue is equal to 1.4 cm such that it can be easily removed from the opening d2 of the pouch 1. The length of the lower base d1 equal to 0.5 cm combined with the length d7 of the tongue equal to 7 cm provides a surface area that is sufficient for receiving a fragrant substance.

In one embodiment as shown, the tongue 2 is impregnated, on the apparent face, with microcapsules 5 containing an odorous substance such as fragrance. Conversely, the cap 3 is devoid of capsules.

The microcapsules take the form of a mixture of microcapsules, the membrane whereof has variable mechanical properties. More specifically, the mixture contains microcapsules having weak membranes which are distributed on the surface of the tongue, in addition to microcapsules having strong membranes which are included in the thickness of the tongue, in the vicinity of the surface.

FIG. 2 shows an exploded, perspective view of the device in FIG. 1. The sampling device comprises three elements, respectively two outside walls 1*a*, 1*b* and one intermediate wall 1*c* constituting the pouch. The intermediate wall 1*c* is that provided with the applicator, which comprises the tongue 2 and the cap 3. The tongue 2 is precut 6 in the intermediate wall 1*c*. The two elements 1*a* and 1*b* are laminated on the element 1*c* with the exception of the surface facing the surface occupied by the tongue. Before first use, the tongue 2 is fastened to the device by the precut shape 6.

In practice, the user removes the tongue from the pouch, causing the precut shape 6 to break away and simultaneously causing the weakest membranes of the microcapsules to rupture, by friction. The user can then choose either to inhale the fragrance that has escaped from the microcapsules, or to brush the tongue over the skin. The operation can then be renewed by re-inserting and removing the tongue, causing the membranes of the microcapsules that did not break during the first passage to break. The microcapsules located in the body of the tongue in the vicinity of the surface will be able to reveal the fragrance contained therein by exerting pressure on the pouch when removing the tongue or by rubbing the tongue against the skin.

Figure 3:
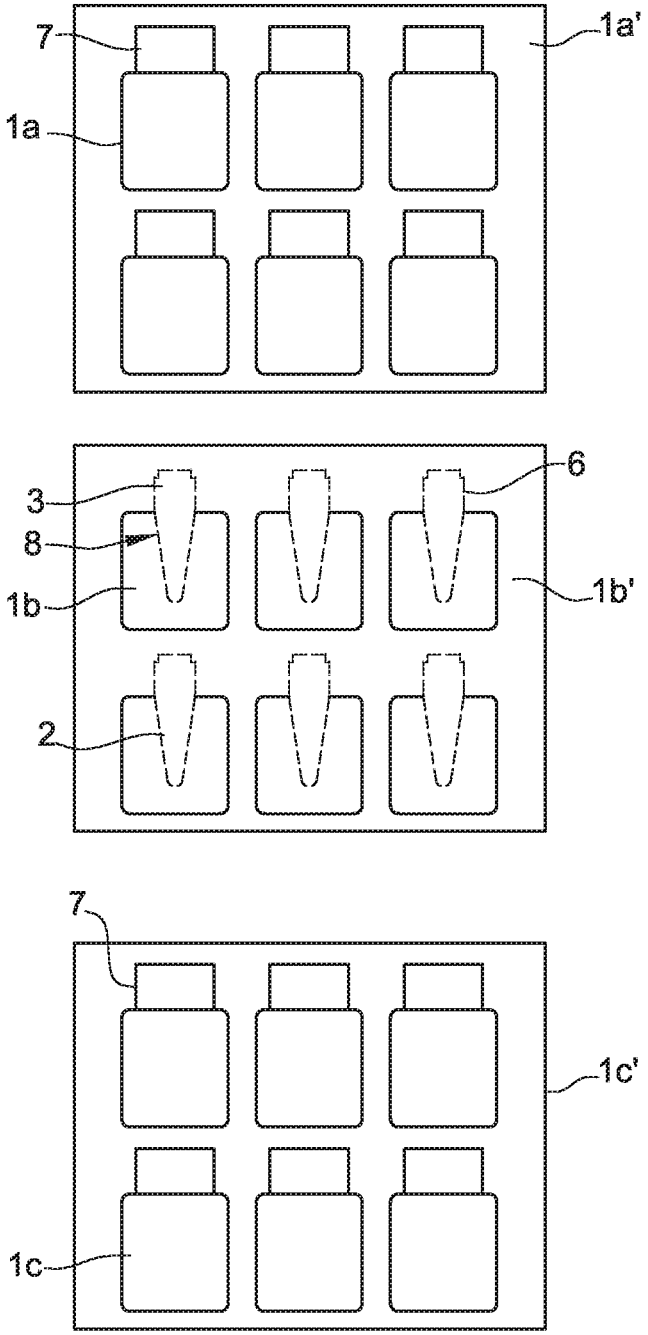
FIG. 3 is a diagrammatic view of the method for manufacturing the sampling device in FIG. 1.

FIG. 3 shows the main steps of the manufacturing method.

In a first support 1*a'*:

- a first area 1*a* is identified, corresponding to one of the two outside walls of the pouch and a second area 7 is identified in the continuation of the first area, the surface area whereof is larger than that of the cap 3,
- the second area 7 is recessed,
- in a second support 1*c'*,
- a first area 1*c* is identified, corresponding to the intermediate wall of the pouch,
- a second area 8 is identified, corresponding to the shape of the applicator comprising the tongue 2, which is continued by the cap 3,
- the part corresponding to the tongue 2 is precut 6,
- fragrance is selectively applied to the face facing the tongue 2,
- in a third support 1*b'*,
- a first area 1*b* is identified, corresponding to the second outside wall and a second area 7 is identified in the continuation of the first area, the surface area whereof is larger than that of the cap 3,
- the second area 7 is recessed,
- the first 1*a'* and third 1*b'* supports are selectively laminated, in an identified manner, on the second support 1*c'* such that the cap 3 is positioned facing the recessed areas 7,
- the assembly 1*a'*, 1*b'*, 1*c'* at the periphery of the first area 1*a*, 1*b*, 1*c* and of the cap 3 is cut.

For the selective lamination step, an adhesive layer is applied to the support 1*c'* with the exception of the surface occupied by the tongue 2.

Advantageously, the device of the invention can be representative of a perfume bottle of a given brand, thus allowing users to feel like they are holding the perfume bottle.

The invention and the advantages resulting therefrom are clearly understood from the description given hereinabove. In particular, the possible implementation of the device of the invention both for inhalation and for applying fragrance to the skin should be noted. The possibility of diffusing olfactory materials in a repetitive manner without altering the aromas, and in the absence of alcohol, should also be noted.

What is claimed is:

1. Fragrance sampling device (5) comprising a reservoir in the form of a pouch (1), having two outside walls (1*a*, 1*b*) facing one another, intended to receive an applicator in the form of a tongue (2), at least one of the faces of the tongue (2) and/or the inside face of at least one of the outside walls of the pouch (1) containing a fragrant substance (5), the applicator further comprising a grasping means (3) connected to the tongue (2) and fully emerging from the reservoir (1), the applicator being devoid of means for the temporary connection thereof to the outside walls of the pouch, characterized in that the pouch (1) has an intermediate wall (1*c*) sandwiched between the two outside walls (1*a*, 1*b*), the intermediate wall having a precut in the shape of the tongue, wherein the outside walls (1*a*, 1*b*) and the intermediate wall (1*c*) are integral with one another outside of the surface occupied by the tongue (2).

2. Fragrance sampling device according to claim 1, characterized in that the pouch (1) takes the shape of a bottle in the shape of a perfume bottle.

3. Sampling device according to claim 1, characterized in that the grasping means (3) constitutes a continuation of the tongue (2).

4. Sampling device according to claim 1, characterized in that the grasping means (3) does not contain a fragrant substance (5).

5. Sampling device according to claim 1, characterized in that the tongue (2) has an overall trapezoidal shape having a long base and a short base, the long base being located at the opening of the pouch and the short base being located in the vicinity of the bottom of the pouch.

6. Sampling device according to claim 1, characterized in that it is made entirely or partially of paper, cardboard or silicone.

7. Sampling device according to claim 1, characterized in that the fragrant substance takes the form of a mixture of microcapsules (5).

8. Sampling device according to claim 7, characterized in that the microcapsules (5) have membranes with variable mechanical strengths.

9. Sampling device according to claim 1, characterized in that the fragrant substance takes the form of a cream or of a gel.

10. Device according to claim 1, characterized in that one or both of the two faces of the tongue (2) contain a fragrant substance.

11. Method for manufacturing a fragrance sampling device comprising a reservoir (1) in the form of a pouch intended to receive an applicator in the form of a tongue (2), at least one of the faces whereof contains a fragrant substance (5), and a grasping means (3), the pouch having two outside walls (1*a*, 1*b*) and an intermediate wall (1*c*) sandwiched between the two outside walls (1*a*, 1*b*), the intermediate wall (1*c*) having a precut shape (6) in the shape of the tongue (2), comprising:

in a first support (1*a*'):

identifying a first area (1*a*) corresponding to the first outside wall and a second area (7) in the continuation of the first area (1*a*) and having a larger surface area than that of the grasping means (3), recessing the second area (7), in a second support (1*c*'), identifying a first area (1*c*) corresponding to the intermediate wall (1*c*) of the pouch (1), identifying a second area (8) corresponding to the shape of the applicator comprising the tongue (2) continued by the grasping means (3), precutting (6) at least the part corresponding to the tongue (2), selectively applying fragrance to at least one face of the tongue (2), in a third support (1*b*'), identifying a first area (1*b*) corresponding to the second outside wall and a second area (7) in the continuation of the first area and having a larger surface area than that of the grasping means (3), recessing the second area, selectively laminating, the first (1*a*') and third (1*b*') supports on the second support (1*c*') such that the grasping means (3) is positioned facing the recessed areas, cutting the assembly (1*a*', 1*b*', 1*c*') at the periphery of the first area (1*a*, 1*b*, 1*c*) and of the grasping means (3).

12. Method for applying fragrance on the skin implementing the device claimed in claim 1, characterized in that it consists of releasing the fragrant substance by friction between the applicator and the outside walls of the pouch when removing said applicator, then of brushing the skin with the applicator.

13. Fragrance sampling device (5) comprising two outside walls (1*a*, 1*b*) and one intermediate wall (1*c*) constituting together a pouch (1), the intermediate wall (1*c*) defining an applicator comprising a tongue (2) and a cap (3), the tongue (2) being delimited by precuts (6) in the intermediate wall (1*c*), the cap (3) fully emerging from the pouch (1), the outside walls (1*a*, 1*b*) being laminated on the intermediate wall (1*c*) with the exception of the surfaces facing the tongue (2), at least one of the faces of the tongue (2) and/or the inside face of at least one of the outside walls (1*a*, 1*b*) of the pouch (1) containing a fragrant substance, so that the tongue (2) is initially fastened by the precuts (6) before first use and then removed from the pouch (1), causing the precuts (6) to break away.

14. Sampling device according to claim 13, characterized in that the tongue (2) has an overall trapezoidal shape having a long base and a short base, the long base being located at the opening of the pouch and the short base being located in the vicinity of the bottom of the pouch.

15. Sampling device according to claim 13, characterized in that it is made entirely or partially of paper, cardboard or silicone.

16. Sampling device according to claim 13, characterized in that the fragrant substance takes the form of a mixture of microcapsules (5).

17. Sampling device according to claim 16, characterized in that the microcapsules (5) have membranes with variable mechanical strengths.

* * * * *